US010809649B2

(12) United States Patent
Fumoto et al.

(10) Patent No.: US 10,809,649 B2
(45) Date of Patent: Oct. 20, 2020

(54) DEVELOPER SUPPLY CONTAINER

(71) Applicant: CANON KABUSHIKI KAISHA, Tokyo (JP)

(72) Inventors: Masataka Fumoto, Tokyo (JP); Dai Kanai, Abiko (JP); Kiyoshi Oyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/551,982

(22) Filed: Aug. 27, 2019

(65) Prior Publication Data

US 2020/0073280 A1 Mar. 5, 2020

(30) Foreign Application Priority Data

Aug. 30, 2018 (JP) ..... 2018-162136

(51) Int. Cl.
*G03G 15/08* (2006.01)

(52) U.S. Cl.
CPC ..... *G03G 15/0881* (2013.01)

(58) Field of Classification Search
CPC ..... G03G 15/0872; G03G 15/0881; G03G 15/0898
See application file for complete search history.

(56) References Cited

U.S. PATENT DOCUMENTS 6,104,900 A * 8/2000 Ishikawa ..... G03G 15/0126 399/227
6,298,208 B1 * 10/2001 Kawamura ..... G03G 15/0868 399/103
7,962,064 B2 * 6/2011 Asai ..... G03G 15/087 399/12
7,983,592 B2 * 7/2011 Naito ..... G03G 15/0886 399/102
8,155,568 B2 * 4/2012 Naito ..... G03G 15/087 399/262
8,326,194 B2 12/2012 Nakagaki et al.
8,478,171 B2 * 7/2013 Sasaki ..... G03G 15/087 399/120
8,532,522 B2 * 9/2013 Kawamura ..... G03G 15/0872 399/102
9,429,904 B2 8/2016 Yasumoto et al.
9,632,457 B2 4/2017 Koseki et al.
10,197,960 B2 2/2019 Torikata et al.
2016/0313677 A1 10/2016 Oyama
2018/0157203 A1 6/2018 Mori et al.
2019/0354044 A1 11/2019 Torimaru et al.

FOREIGN PATENT DOCUMENTS

JP 2006243383 A * 9/2006
JP 2006-308781 A 11/2006

OTHER PUBLICATIONS

Co-pending U.S. Appl. No. 16/555,253, filed Aug. 29, 2019.

* cited by examiner

*Primary Examiner* — Walter L Lindsay, Jr.
*Assistant Examiner* — Milton Gonzalez
(74) *Attorney, Agent, or Firm* — Venable LLP

(57) ABSTRACT

A developer supply container includes an accommodating portion, a discharging portion, a sealing member, a first restricting portion, and a second restricting portion positioned upstream of the first restricting portion with respect to an inserting direction of the accommodating portion. The seal member is provided between the first restricting portion and the second restricting portion with respect to a rotational axis direction of the accommodating portion.

5 Claims, 14 Drawing Sheets

(a)

(b)

(a)

(b)

DEVELOPER SUPPLY CONTAINER

FIELD OF THE INVENTION AND RELATED ART

The present invention relates to a developer supply container suitably usable with an image forming apparatus of an electrophotographic type, such as a primer, a copying machine, a facsimile machine, a multifunction machine and so on.

In an image forming apparatus of the electrophotographic type, an image is formed using the developer, and the developer is consumed in accordance with the image forming operation. Therefore, the image forming apparatus is equipped with a developer supply device for supplying the developer into the image forming apparatus. Japanese Laid-Open Patent Application 2006-308781 discloses a developer supplying apparatus to which a developer supply container containing the developer to be supplied into the image forming apparatus is detachably mountable. The developer supply container comprises a discharging chamber (discharging portion) provided with a discharge opening, and an accommodating chamber (accommodating portion) capable of accommodating the developer, the accommodating chamber being rotatable relative to the discharging portion. The accommodating portion is engaged with the discharging portion with a gap in order to permit the rotation (loose fitting), and therefore, a sealing member in the form of a ring is provided to prevent leakage of the developer through the gap to the outside of the developer supply container.

When the loose fitting is used between the accommodating portion and the discharging portion, a whirling motion tends to occur in which the accommodating portion moving in the radial direction crossing with the rotational axis direction, due to variations in the parts of the device and variation in the rotational load, or the like. If this occurs, there is a liability that the developer leaks through the contact portion between the accommodating portion and the sealing member. For this reason, an elastic sealing member is used, and the sealing member is compressed in the rotational axis direction by the discharging portion and the accommodating portion, so as to suppress the whirling motion of the accommodating portion. In addition, with the structure disclosed in the Japanese Laid-Open Patent Application (JP-A) 2006-308781, a contact surface of the sealing member in the discharging portion or the accommodating portion is slanted, so that a strong force is produced by the sealing member against the whirling motion during the rotation of the accommodating portion, in order to suppress the whirling motion.

When the loose fitting is used between the accommodating portion and the discharging portion, the accommodating portion may rotate with inclination in the radial direction relative to the discharging portion. For example, when a deviation in mounting position between the discharging portion and the accommodating portion is large and when the accommodating portion is rotated through a driving force transmission from an external driving source using a gear portion provided at the outer circumferential periphery of the accommodating portion (a radial force applied by the driving load), the accommodating portion may rotate with the inclination relative to the discharging portion. In the case of the developer supply container disclosed in the above-mentioned JP-A 2006-308781, when the accommodating portion rotates in an inclined state, the pressure applied in the rotational axis direction to the sealing member is not even over the circumference. Then, the sealing member may be locally deformed at the position where the pressure is large. If this occurs, the elasticity of the sealing member at such a position is lost, with the result that the deformation may increase to such an extent that a gap is produced between the accommodating portion and the sealing member depending on use, and thus the developer leaked out of the accommodating portion through the gap in some instances.

Accordingly, it is an object of the present invention to provide a developer supply container in which a whirling motion of an accommodating portion is suppressed by a sealing member, and that deformation of the sealing member attributable to rotation of the accommodating portion with an inclination relative to a discharging portion is suppressed.

SUMMARY OF THE INVENTION

According to an aspect of the present invention, there is provided a developer supply container mountable in and dismountable from a developer supply device, the developer supply container comprising: an accommodating portion including one end portion provided with an opening, wherein a developer accommodated in the accommodating portion is fed toward the one end portion by rotation of the accommodating portion; a discharging portion including a receiving portion into which the one end portion of the accommodating portion is inserted so as to be rotatable relative to the accommodating portion, and a discharge opening configured to discharge the developer supplied through the opening of the accommodating portion, wherein the accommodating portion is nonrotatably mounted to the developer supply device; a sealing member configured to seal a space between the one end portion and the receiving portion by being elastically compressed; a first restricting portion provided on the one end portion and configured to restrict movement of the accommodating portion in a radical direction crossing a rotational axis direction of the accommodating portion in contact with the receiving portion; and a second restricting portion contactable to the receiving portion on a side upstream of the first restricting portion with respect to an inserting direction of the one end portion and configured to restrict the movement of the accommodating portion in the radial direction, wherein the seal member is provided between the first restricting portion and the second restricting portion with respect to the rotational axis direction.

Further features of the present invention will become apparent from the following description of exemplary embodiments with reference to the attached drawings.

Figure 3:
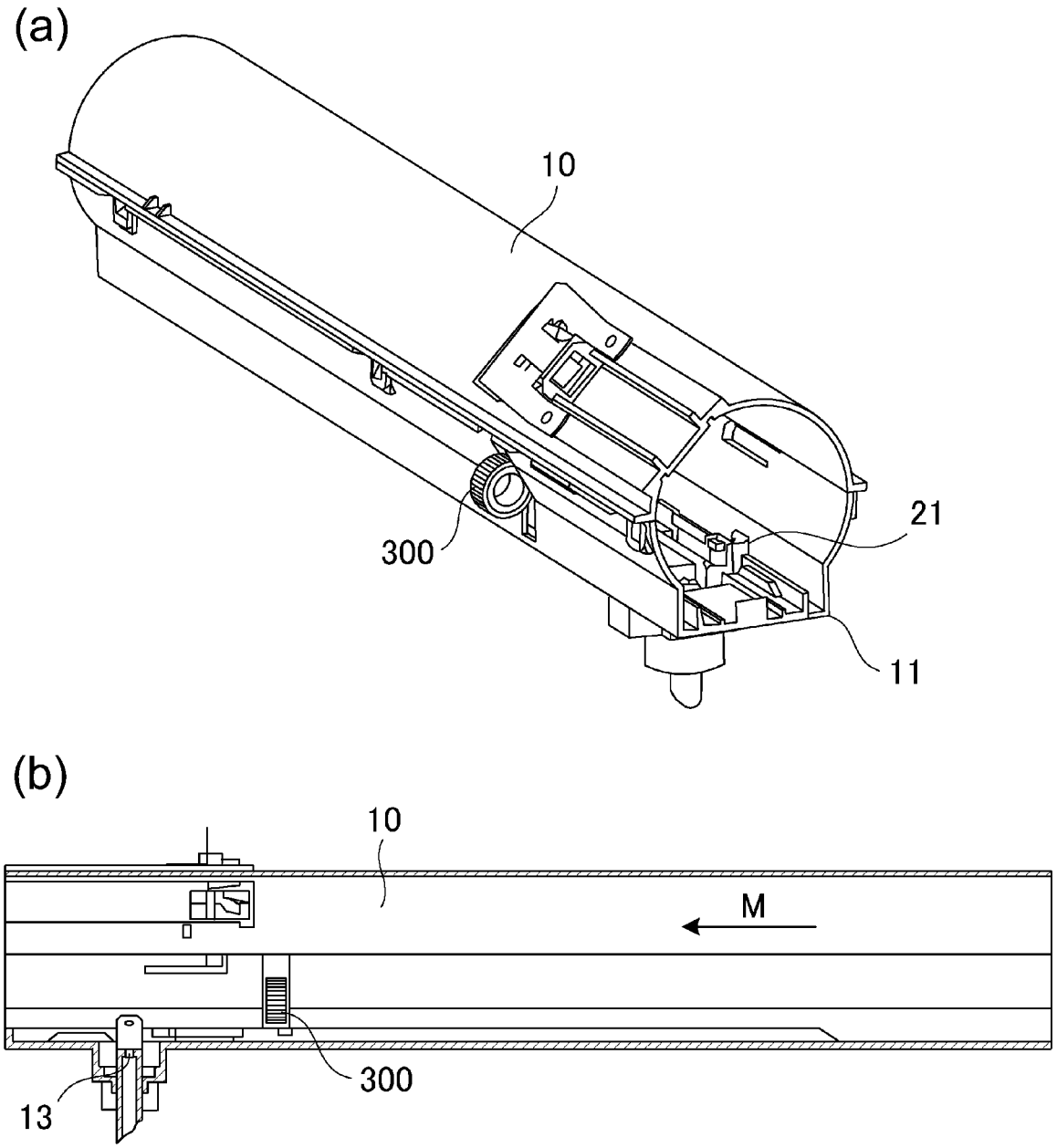

Part (a) of FIG. 3 is a perspective view of an outer appearance of a mounting portion, and part (b) of FIG. 3 is a sectional view of the mounting portion.

Figure 4:
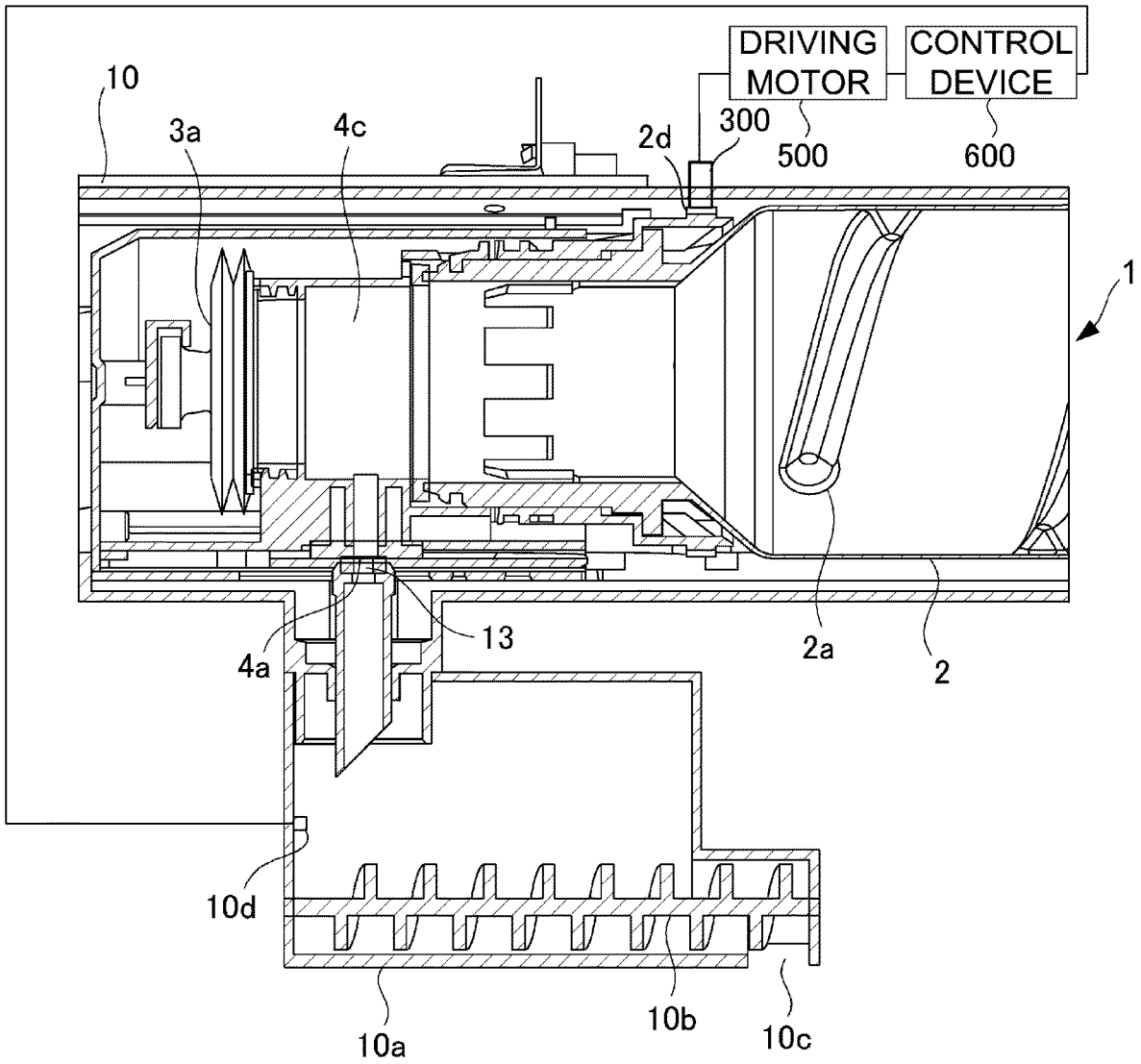
Figure 5:
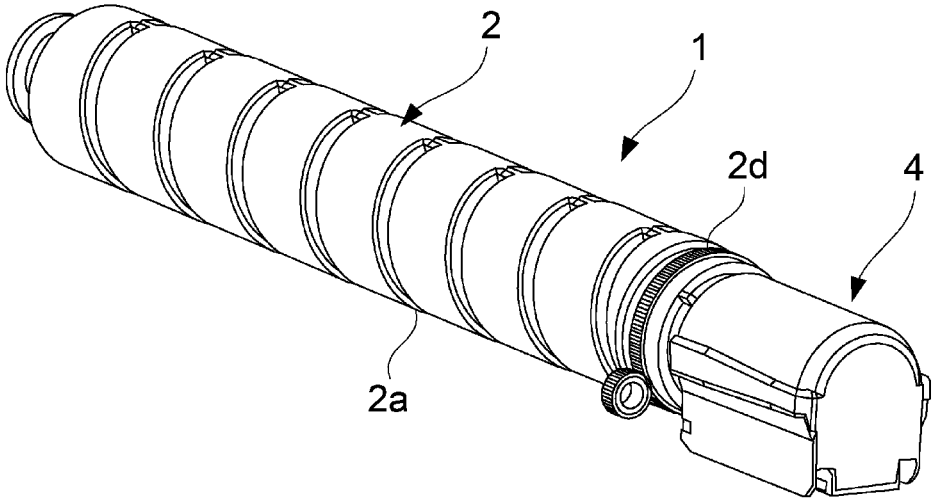
Figure 5:
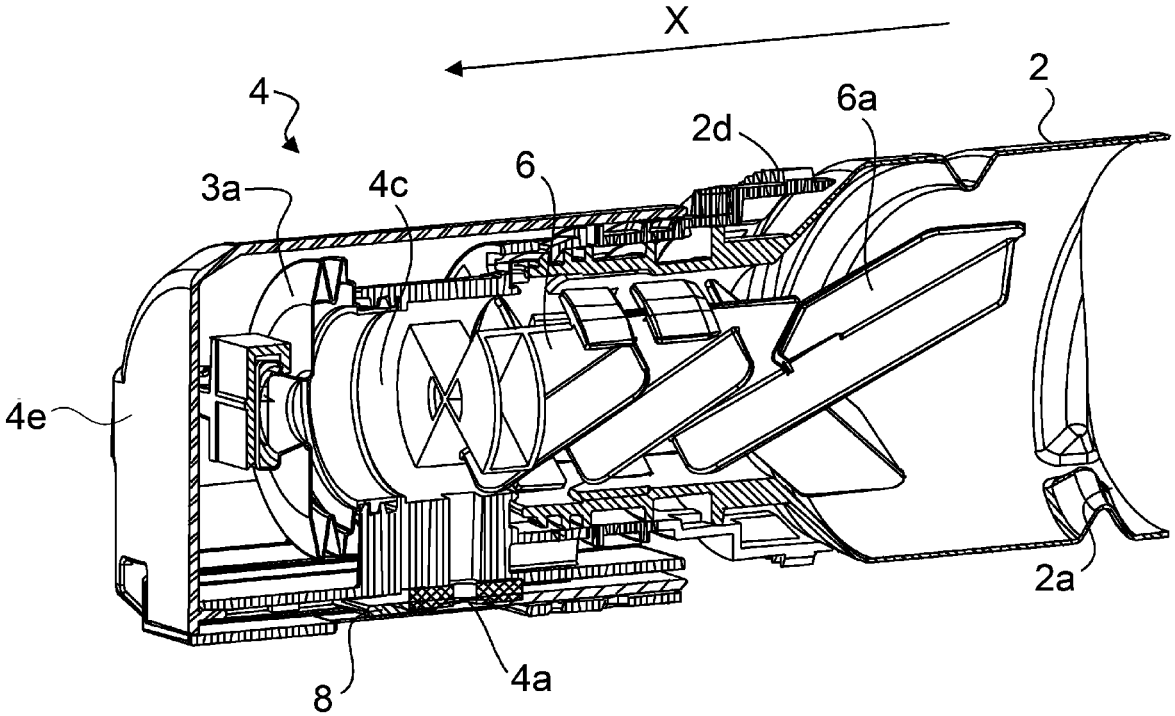

FIG. 4 is an enlarged view illustrating the developer supply container and a developing supplying device, Part (a) of FIG. 5 is a perspective view of an outer appearance of the developer supply container, and part (b) of FIG. 5 is a perspective sectional view of the developer supply container.

Figure 6:
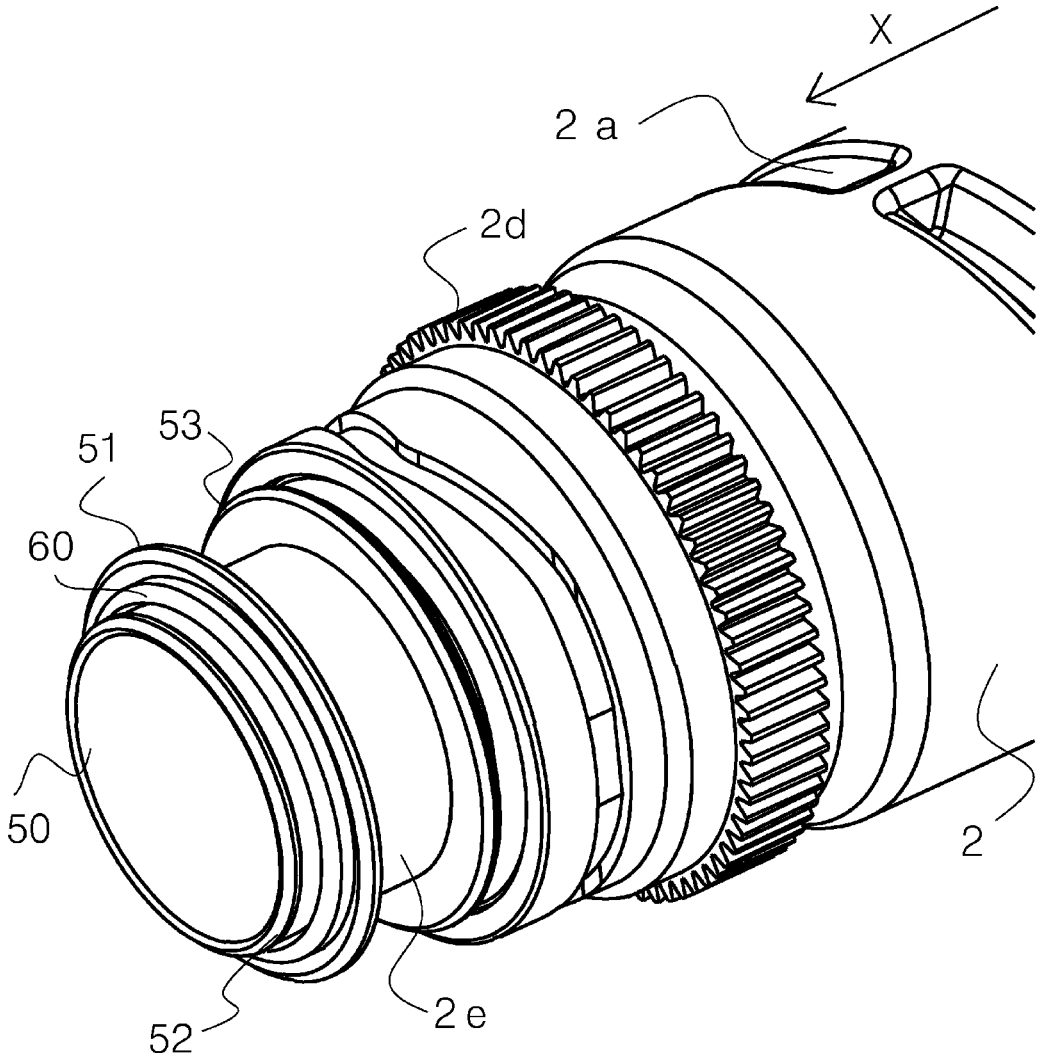

FIG. 6 is an enlarged perspective view of an accommodating portion according to a first embodiment of the present invention.

Figure 7:
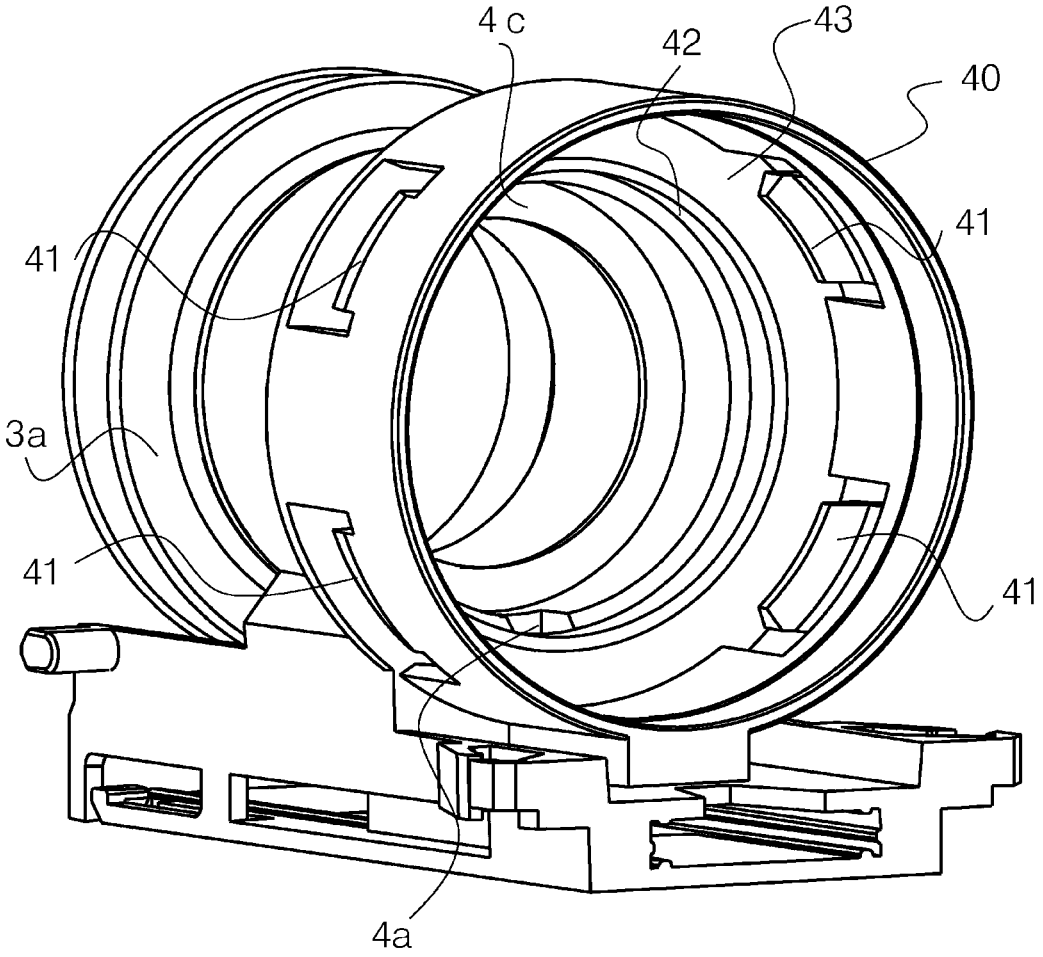

FIG. 7 is a perspective view of a flange portion in the first embodiment.

Figure 8:
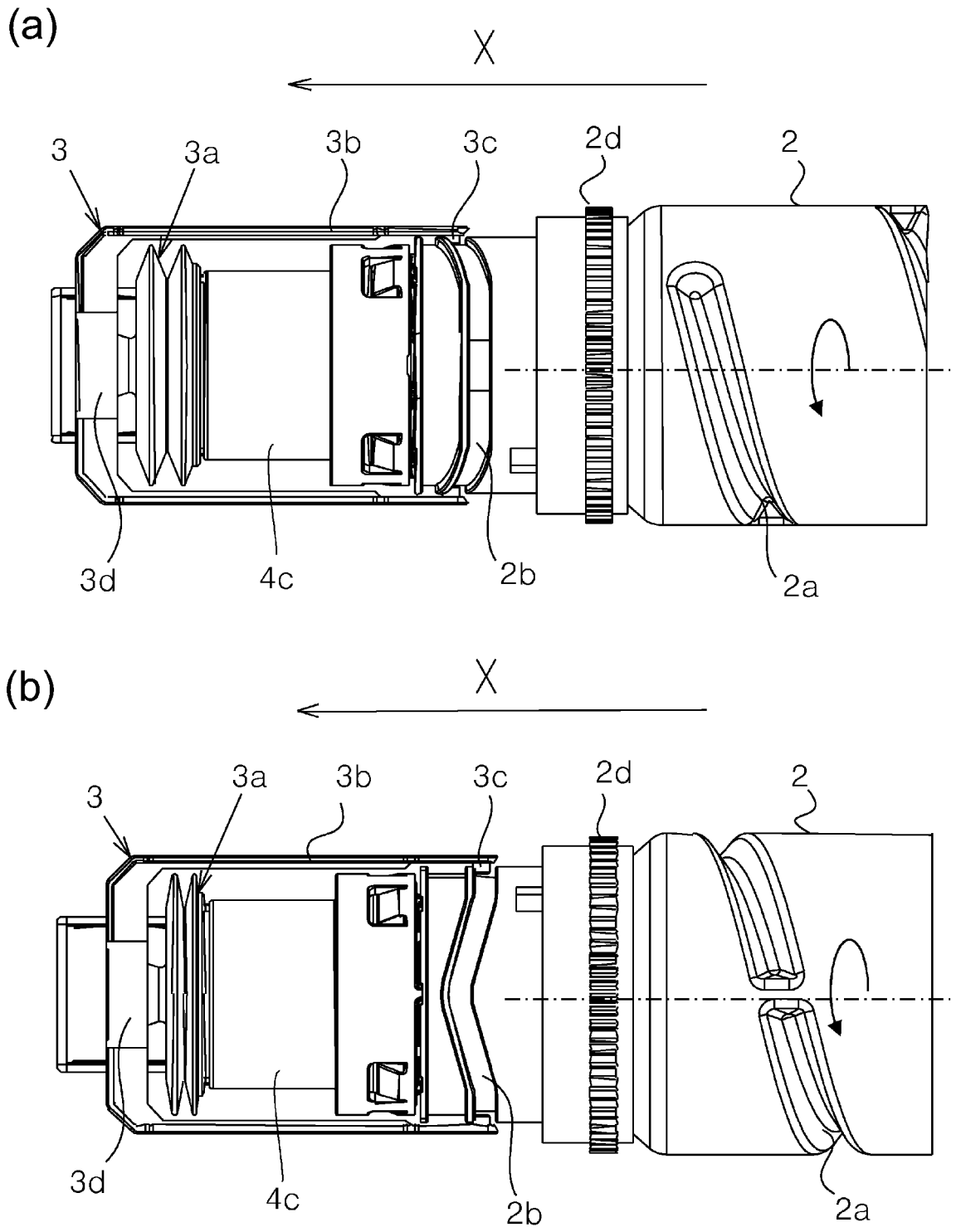

Part (a) of FIG. 8 is a partial view in a state in which a pump portion is expanded to the maximum usable limit, and part (b) of FIG. 8 is a partial view in a state in which the pump portion is contracted to the minimum usable limit.

Figure 9:
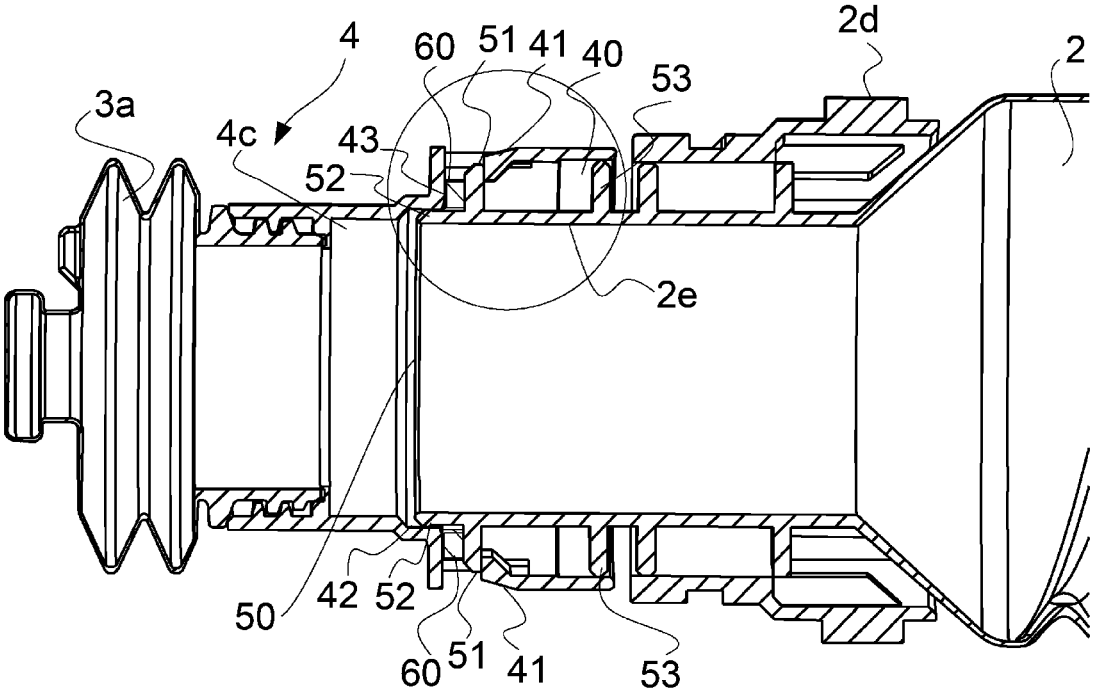
Figure 9:
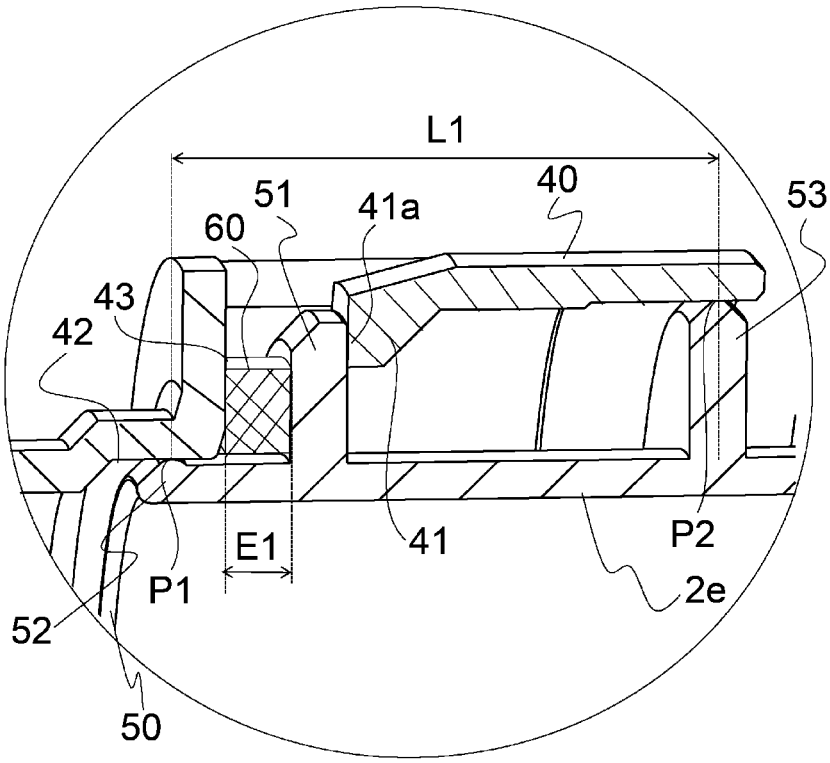

Part (a) of FIG. 9 is a partial sectional view illustrating the mounting of a flange portion and the accommodating portion, in the first embodiment, and part (b) is a partial enlarged view illustrating the mounting of the flange portion and the accommodating portion, in the first embodiment.

Figure 10:
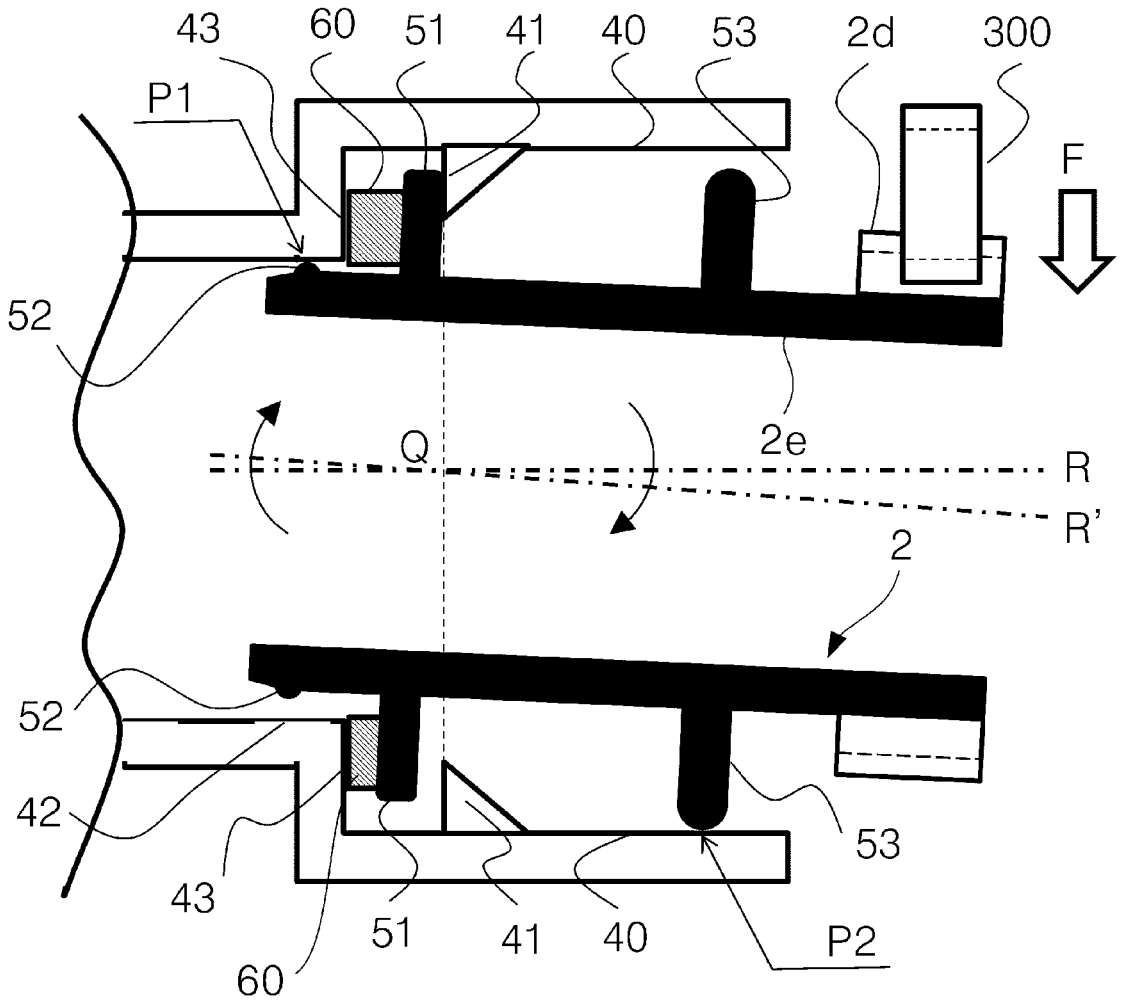

FIG. 10 is a schematic view illustrating restriction of the accommodating portion relative to the flange portion, in the first embodiment.

Figure 11:
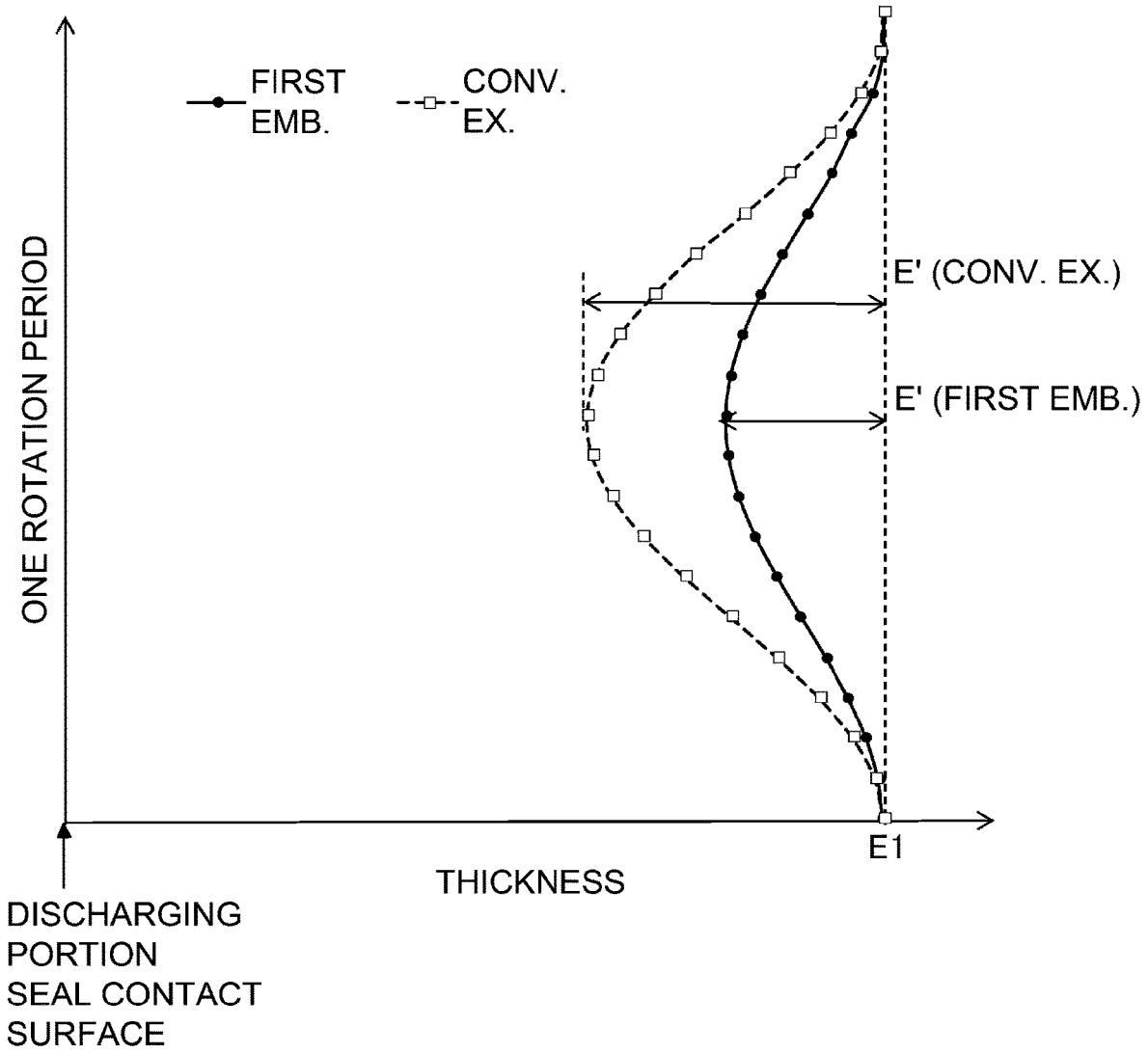

FIG. 11 is a graph of comparison between the first embodiment and a conventional example in deformation of a sealing member.

Figure 12:
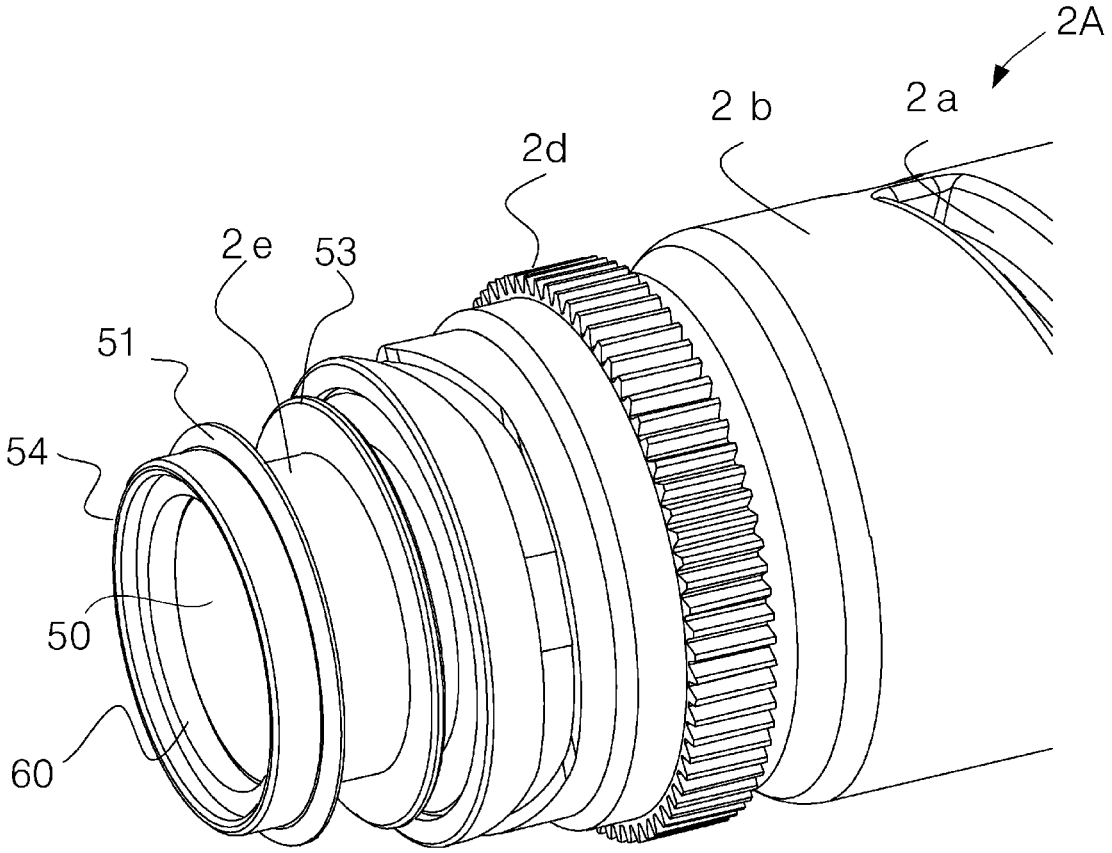

FIG. 12 is an enlarged perspective view of an accommodating portion in a second embodiment of the present invention.

Figure 13:
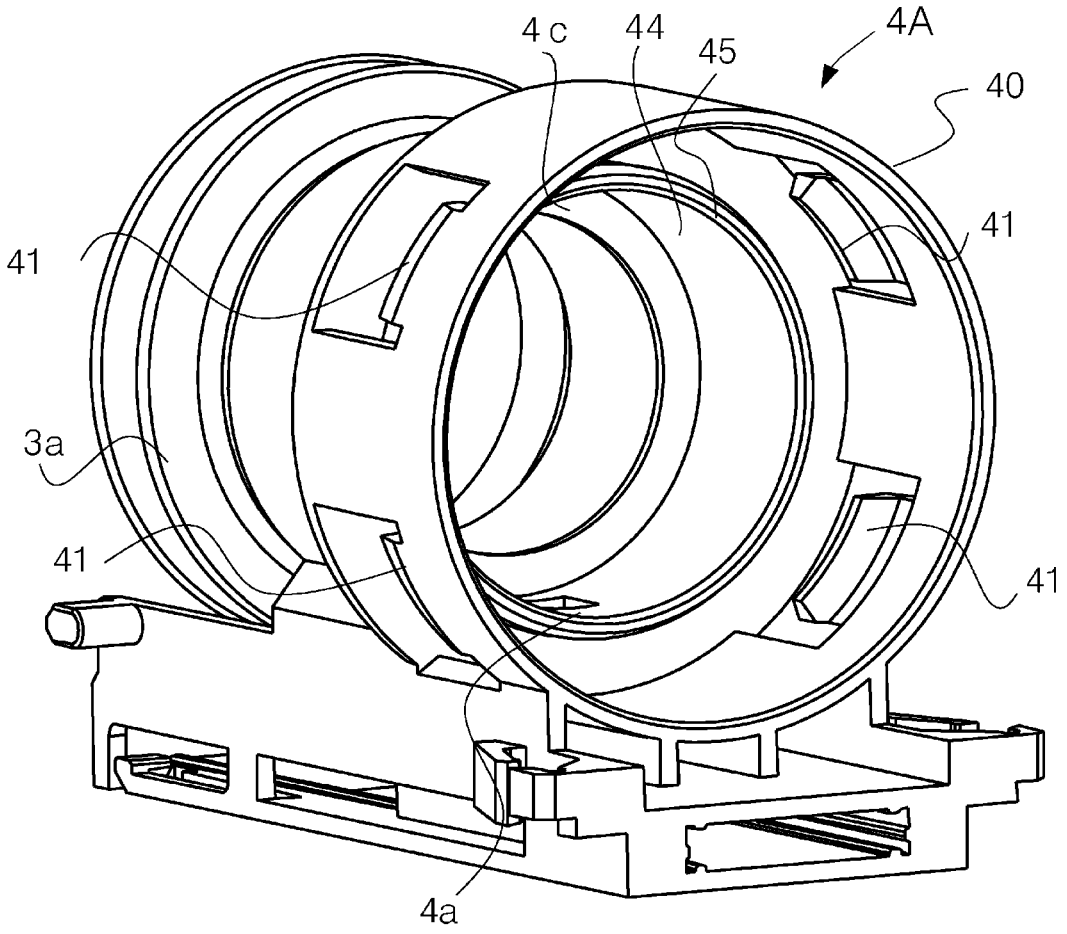

FIG. 13 is a perspective view of a flange portion in the second embodiment of the present invention.

Figure 14:
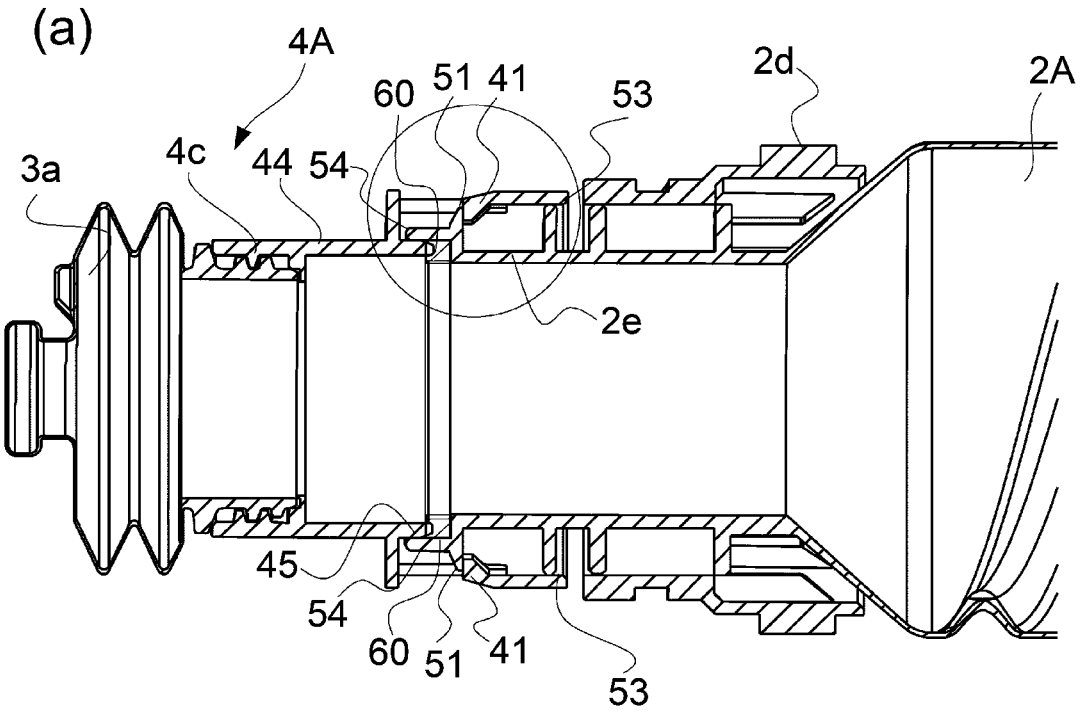
Figure 14:
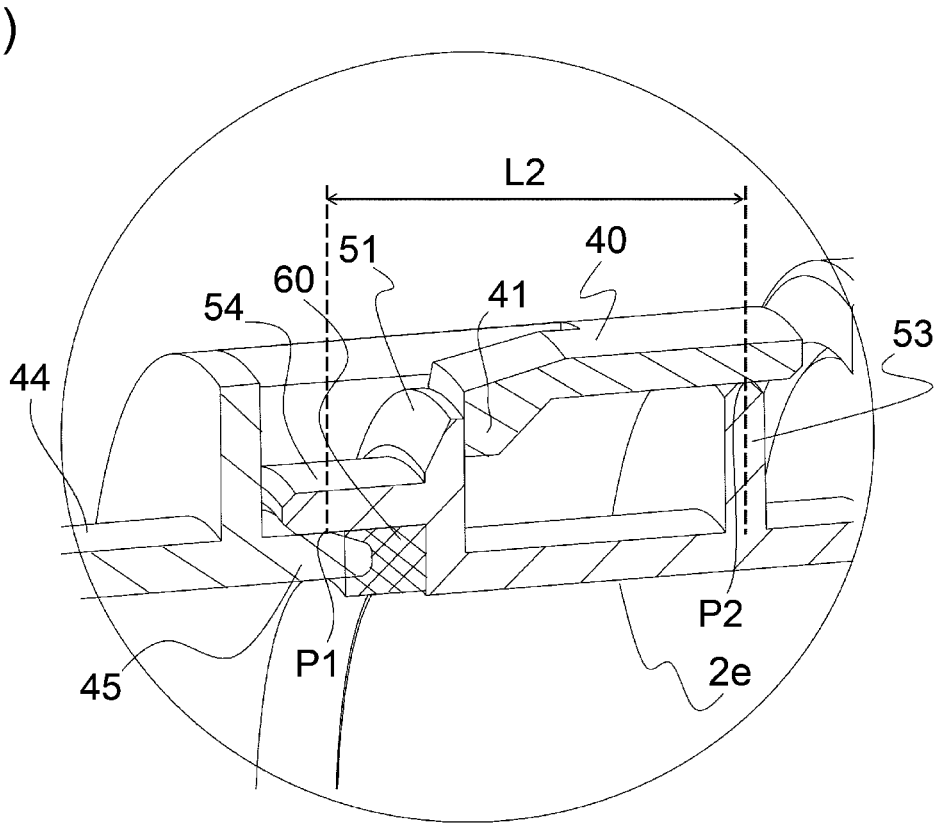

Part (a) of FIG. 14 is a partial sectional view illustrating mounting of the flange portion and the accommodating portion, in the second embodiment of the present invention, and part (b) of FIG. 14 is a partial enlarged sectional view illustrating mounting of the flange portion and the accommodating portion.

DESCRIPTION OF EMBODIMENTS

First Embodiment

In the following, an image forming apparatus according to this embodiment will be described. First, a summary of the image forming apparatus will be described and then a developer supply device and a developer supply container which are mounted in this image forming apparatus will be described.

(Image Forming Apparatus)

As the image forming apparatus in which the developer supply container is mountable in and dismountable from the developer supply device, the image forming apparatus employing an electrophotographic type will be described with reference to FIG. 1.

Figure 1:
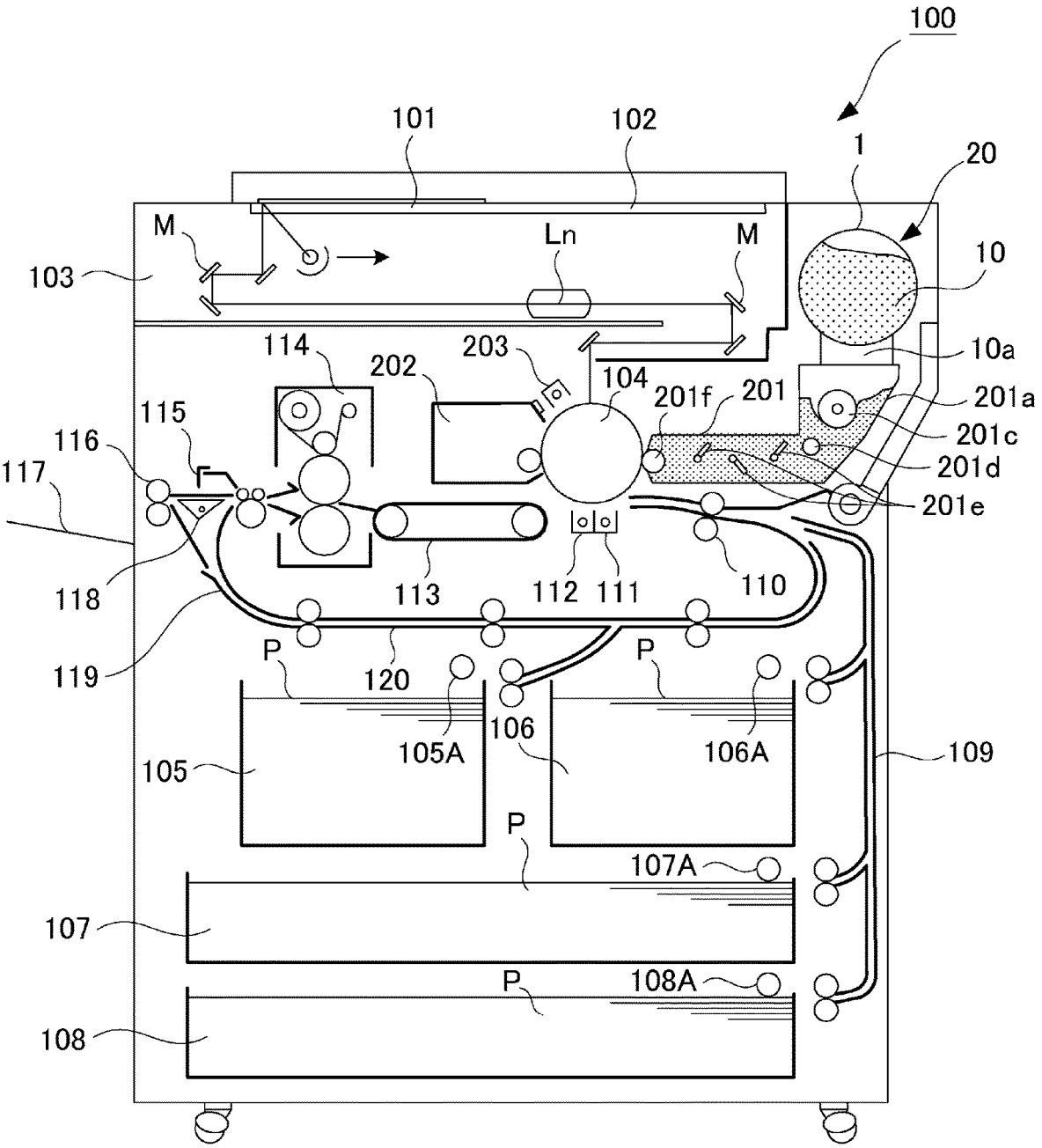
FIG. 1 is a sectional view of an image forming apparatus usable with a developer supply container according to an embodiment of the present invention.

As shown in FIG. 1, an image forming apparatus 100 includes an original supporting platen glass 102, and an original 101 is placed on this original supporting platen glass 102. Then, an optical image depending on image information of the original 101 is formed on a photosensitive member 104 electrically charged uniformly by a charger 203 in advance, by a plurality of mirrors M and a lens Ln of an optical portion 103, whereby an electrostatic latent image is formed on the photosensitive member 104. This electrostatic latent image is visualized with toner (one component magnetic toner) as a developer (dry powder) by a dry developing device (one component developing device) 201*a*. That is, a toner image (developer image) is formed on the photosensitive member 104.

In the image forming apparatus 100, a plurality of cassettes 105-108 for accommodating recording materials (hereinafter referred to as sheets) are provided. Of these cassettes 105-108 in which sheets P are stacked, the sheet P is fed from either one of the cassettes selected on the basis of information or a size of the original 101 which are inputted by an operator through an operating portion (not shown) provided on the image forming apparatus 100. Here, as the recording material (sheet), it is not limited to a sheet (paper), but for example, an OHP sheet and the like can be appropriately used and selected.

Then, a single sheet P fed by either one of feeding and separation devices 105A-108A is fed to a registration roller pair 110 via a feeding portion 109. Then, this sheet P is conveyed to a transfer portion in synchronism with rotation of the photosensitive member 104 and scanning by the optical portion 103.

The transfer portion includes a transfer charger 111 and a separation charger 112. The transfer charger 111 and the separation charger 112 are provided opposed to the photosensitive member 104. The toner image formed on the photosensitive member 104 is transferred onto the sheet P by the transfer charger 111. Then, the sheet P on which the developer image (toner image) is transferred is separated from the photosensitive member 104*by* the separation charger 112.

Thereafter, the sheet P fed by a feeding portion 113 is heated and pressed in a fixing portion 114 and the developer image is fixed on the sheet P, and in the case of one-side copying, the sheet P passes through a discharging reverse portion 115 and is discharged to a discharge tray 117 by a discharging roller pair 116.

On the other hand, in the case of double-side copying, the sheet P passes through the discharging reverse portion 115, and a part of the sheet P is once discharged to an outside of the image forming apparatus 100 by the discharging roller pair 116. Thereafter, a trailing end of the sheet P passes through a flapper 118, and the sheet P is fed again in the image forming apparatus 100 by controlling the flapper 118 at timing when the sheet P is still nipped by the discharging roller pair 116 and by reversely rotating the discharging roller pair 116. Thereafter, the sheet P is fed to the registration roller pair 110 via re-feeding conveying portions 119 and 120, and then is fed along a path similar to the path in the case of the one-side copying and thus is discharged onto the discharge tray 117.

In the image forming apparatus 100 having the above-described constitution, around the photosensitive member 104, image forming process devices such as a developing device 201, a cleaner portion 202 and a primary charger 203 are provided. Incidentally, the developing device 201 develops the electrostatic latent image formed on the photosensitive member 104 by the optical portion 103 on the basis of the image information of the original 101, by depositing the developer on the electrostatic latent image. Further, the primary charger 203 electrically charges uniformly a photosensitive member surface in order to form a desired electrostatic latent image on the photosensitive member 104. The cleaner portion 202 removes the developer remaining on the photosensitive member 104.

(Developing Device)

Figure 2:
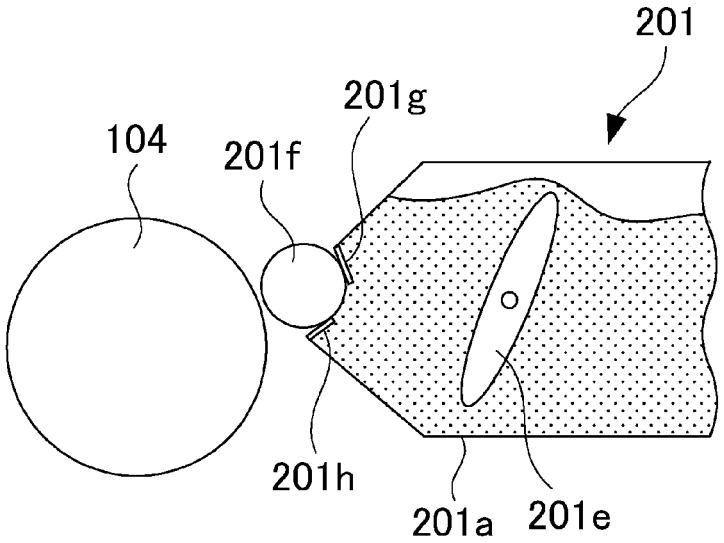
FIG. 2 is a schematic view of a developing device.

Next, the developing device 201 will be described with reference to FIGS. 1 and 2. As shown in FIGS. 1 and 2, the developing device 201 includes a developer container 201*a*, a developing roller 201*f*, a stirring member 201*c* and feeding members 201*d* and 201*e*. In the case of this embodiment, to the developing device 201, the above-described one component magnetic toner is supplied as the developer from a developer supply device 20 in which a developer supply container 1 described later is mounted. The developer supplied to the developing device 201 is stirred by the stirring member 201*c* and is sent to the developing roller 201*f* by the feeding members 201*d* and 201*e*, and then is supplied to the photosensitive member 104 by the developing roller 201*f*.

In the developing device 201, a developing blade 201*g* for regulating a coat amount of the developer on the developing roller 201*f* is provided in contact with the developing roller 201*f*. Further, in the developing device 201, a leakage-preventing sheet 201*h* is provided in contact with the developing roller 201*f* in order to prevent leakage of the developer from between the developing roller 201*f* and the developing container 201*a*.

In this embodiment, as the developer which should be supplied from the developer supply device 20, the one component magnetic toner is used, but the developer is not limited thereto. For example, a two component developing device in which development is carried out using a two component developer in which a magnetic carrier and non-magnetic toner are mixed with each other may also be used, and in that case, as the developer, the non-magnetic toner is supplied. In this case, a constitution in which as the developer, not only the non-magnetic toner but also the magnetic carrier are supplied in combination may also be employed.

(Developer Supply Device)

Next, the developer supply device 20 will be described using part (a) of FIG. 3 to FIG. 4 while making reference to FIG. 1. The developer supply device 20 includes, as shown in FIG. 1, a mounting portion 10 in which the developer supply container 1 is mountable and from which the developer supply container 1 is dismountable and a hopper 10*a* for temporarily storing the developer discharged from the developer supply container 1. The mounting portion 10 is a cylindrical member, in which a space for permitting accommodation of the developer supply container 1 is formed. The developer supply container 1 has a constitution in which the developer supply container 1 is inserted into the mounting portion 10 in an arrow M direction as shown in part (b) of FIG. 3. A longitudinal direction (rotational axis direction of an accommodating portion described later) of the developer supply container 1 substantially coincides with an inserting (insertion) direction of the developer supply container 1. Incidentally, a dismounting direction (removing direction) of the developer supply container 1 from the mounting portion 10 is an opposite direction to arrow M direction of part (b) of FIG. 3.

The mounting portion 10 is, as shown in part (a) of FIG. 3, provided with a rotational direction restricting portion 11 for restricting movement of a flange portion 4 (part (a) of FIG. 5 described later) of the developer supply container 1 in a rotational direction by contact of the rotational direction pressure restricting portion 11 with the flange portion 4.

The mounting portion 10 is provided with a developer receiving opening (developer receiving hole) 13 for receiving the developer discharged from the developer supply container 1 by establishing communication with a discharge opening (discharge hole) 4*a* of the developer supply container 1. Then, the developer discharged through the discharge opening 4*a* of the developer supply container 1 is supplied to the hopper 10*a* through the developer receiving opening 13. The hopper 10*a* includes a feeding screw 10*b* for feeding to the developer toward the developing device 201 and a developer sensor 10*d* for detecting an amount of the developer accommodated in the hopper 10*a*. The developer discharged from the developer supply container 1 is supplied to the developing device 201 by the hopper 10*a*.

Further, the mounting portion 10 includes, as an external gear, a driving gear 300 functioning as a driving mechanism as shown in parts (a) and (b) of FIG. 3. To the driving gear 300, a rotational driving force is transmitted from a driving motor 500 (FIG. 4) via a gear train, and the driving gear 300 has a function of imparting the rotational driving force to a gear portion 2*d* (FIG. 4) of the developer supply container 1 in a state in which the developer supply container 1 is set in the mounting portion 10.

As shown in FIG. 4, the driving motor 500 is controlled by a control device 600 including a CPU (central processing unit), ROM (read only memory), RAM (random access memory) and the like. In the case of this embodiment, the control device 600 controls an operation of the driving motor 500 on the basis of developer remaining amount information inputted from the developer sensor 10*d*. Incidentally, in the case of the two component developing device, in place of the developer sensor 10*d*, a magnetic sensor for detecting a toner content in the developer is provided in the developing device 201, and on the basis of a detection result of this magnetic sensor, the operation of the driving motor 500 may only be required to be controlled by the control device 600.

(Developer Supply Container)

Next, the developer supply container 1 according to First Embodiment will be described with reference to part (a) of FIG. 5 to FIG. 8. The developer supply container 1 includes the accommodating portion 2 which is formed in a hollow cylindrical shape and which is provided with an inside space for permitting accommodation of the developer, and includes the flange portion 4, a feeding member 6 and a pump portion 3*a*. The accommodating portion 2 is mounted to the flange portion 4 so as to be rotatable relative to the flange portion 4 by being inserted and loose-fitted in the flange portion 4. Further, although illustration is omitted, in the case where the developer supply container 1 is mounted in the developer supply device 20, an upstream side of the accommodating portion 2 with respect to the insertion direction is placed on the mounting portion 10 (part (a) of FIG. 3) so as to be supported from a lower portion with respect to a direction of gravitation. Therefore, the accommodating portion 2 is capable of rotating in a state in which the accommodating portion 2 is inserted relative to the flange portion 4 (specifically the discharging portion 4*c*).

(Accommodating Portion)

As shown in part (a) of FIG. 5, on an inner surface of the accommodating portion 2, a feeding projection 2*a* which is helically projected is provided. The feeding projection 2*a* functions as a mechanism for feeding the accommodated developer toward a discharging portion 4*c* side (one end portion side, part (b) of FIG. 5) of the flange portion 4 with rotation of the feeding projection 2*a* itself. Further, as shown in FIG. 6, at an outer periphery of the accommodating portion 2, the gear portion 2*d* engageable with the driving gear 300 (part (a) of FIG. 3) of the mounting portion 10 is provided. The gear portion 2*d* receives a driving force from the driving gear 300 engaging with the gear portion 2*d*. The gear portion 2*d* has a constitution in which the gear portion 2*d* is rotatable integrally with the accommodating portion 2. For that reason, by rotation of the accommodating portion 2 rotating with rotation of the gear portion 2*d*, the developer in the accommodating portion 2 is fed in a feeding direction (arrow X direction) by the feeding projection 2*a*. Incidentally, the rotational driving force inputted from the driving gear 300 to the gear portion 2*d* is also transmitted to the pump portion 3*a* through a reciprocating member 3*b* (parts (a) and (b) of FIG. 8). The pump portion 3*a* operates so that an internal pressure of the accommodating portion 2 is alternately switched repetitively between a state in which the internal pressure is lower than ambient pressure and a state in which the internal pressure is higher than the ambient pressure by the driving force received by the gear portion 2*d*.

As shown in FIG. 6, at one end of the accommodating portion 2 on a downstream side with respect to the insertion direction, a small diameter cylindrical portion 2*e* provided, as one end portion, with an opening 50 for permitting discharge of the developer toward the discharging portion 4*c* is formed. In the case of this embodiment, on a free end side of the small diameter cylindrical portion 2*e*, a projected annular portion 52 is provided so that an outer diameter is larger than an outer diameter of the small diameter cylindrical portion 2*e* by about 0.3 mm, for example. Further, on an outer peripheral surface of the small diameter cylindrical portion 2*e*, a first circular rib 51 and a second circular rib 53 which have a ring shape and which project outward in a radial direction crossing the rotational axis direction of the accommodating portion 2 are provided at positions spaced from each other with respect to the longitudinal direction of the developer supply container 2. In other words, in the accommodating portion 2, the small diameter cylindrical portion 2*e* is formed so as to extend to a side downstream of the first circular rib 51 in the insertion direction of the developer supply container 2, and the projected annular portion 52 is provided at the free end portion of the small diameter cylindrical portion 2*e*. As described later, the first circular rib 51 restricts motion of the accommodating portion 2 relative to the discharging portion 4*c* in the rotational axis direction. Further, motion of the accommodating portion 2 in radial direction is restricted by an extended portion (specifically the projected annular portion 52), as a first restricting portion, of the small diameter cylindrical portion 2*e* and by the second circular rib 53 as a second restricting portion. Incidentally, an outer peripheral portion of the small diameter cylindrical portion 2*e* may also be used as the first restricting portion without providing the projected annular portion 52.

To the first circular rib 51 as a rib portion, a ring-shaped seal member 60 formed by an elastic member such as an urethane foam is bonded. The accommodating portion 2 is mounted to the flange portion 4 so as to be rotatable relative to the flange portion 4 in a state that the seal member 60 is elastically deformed. As regards the accommodating portion 2, in order to rotate while sliding with the seal member 2, hermetically in the developer supply container 1 is maintained by the seal member 60.

(Flange Portion)

The flange portion 4 is provided, as shown in part (b) of FIG. 5, with the hollow discharging portion (discharging chamber) 4*c* for temporarily storing and then discharging the developer which is fed from the accommodating portion 2. The discharging portion 4*c* is provided with the discharge opening 4*a* at the bottom thereof. The discharge opening 4*a* is a small hole provided in a range of 0.05-5 mm in diameter. Incidentally, the shape of the discharge opening 4*s* is not limited to a circular shape, but may also be any shape having an opening area equal to an opening area of the discharge opening 4*a* having the above-described diameter. The developer inside the discharging portion 4*c* passes through a discharge path establishing communication between the discharging portion 4*c* and the discharge opening 4*a* and is discharged to an outside of the developer supply container 1 through the discharge opening 4*a*. At a periphery of the discharge opening 4*a*, an opening seal which is perforated is provided. The developer supply container 1 is provided with a shutter 8 at the bottom of the discharging chamber 4*c* so as to sandwich the opening seal between the shutter 8 and the discharging portion 4*c*. The shutter 8 is configured so as to close the discharge opening 4*a* in a state in which the developer supply container 1 is not mounted in the developer supply device 20 and so as to open the discharge opening 4*a* in a state in which the developer supply container 1 is mounted in the developer supply device 20. That is, the shutter 8 is capable of opening and closing the discharge opening 4*a* with a mounting and dismounting operation of the developer supply container 1 relative to the developer supply device 20.

The flange portion 4 is substantially non-rotatable in response to mounting of the developer supply container 1 in the mounting portion 10. Specifically, in order to prevent the flange portion 4 itself from rotating in the rotational direction of the accommodating portion 2, the above-described rotational direction restricting portion 11 is provided (part (a) of FIG. 3). Accordingly, in the state in which the developer supply container 1 is mounted in the mounting portion 10, the discharging portion 4*c* of the flange portion 4 is also in a state in which rotation thereof in the rotational direction of the accommodating portion 2 is substantially prevented (but movement thereto to the extent of play is permitted). On the other hand, the accommodating portion 2 is rotatable in a developer supplying step without being subjected to restriction of rotation in the rotational direction thereof.

As shown in FIG. 7, to the flange portion 4, the pump portion 3*a* is mounted. The flange portion 4 is configured so that the accommodating portion 2 is mountable on a side opposite from the pump portion 3*a*. Specifically, in the order from an upstream side of the discharging portion 4*c* with respect to the insertion direction, as receiving portions, an upstream cylindrical portion (second cylindrical portion) 40 and a downstream cylindrical portion (first cylindrical portion) 42 which are provided for permitting mounting of the accommodating portion 2 through loose fitting are formed. The downstream cylindrical portion 42 includes a seal nipping portion 43 capable of compressing and nipping the seal member 60 between itself and the first circular rib 51. On the other hand, the upstream cylindrical portion 40 is provided with a plurality of locking claws 41, each projecting toward an inside with respect to the radial direction. Mounting of the flange portion 4 and the accommodating portion 2 will be described later.

(Feeding Member)

As shown in part (b) of FIG. 5, in the accommodating portion 2 a plate-like feeding member 6 for feeding the developer, fed from the inside of the accommodating portion 2 by a helical projection (feeding projection) 2*a*, toward the flange portion 4 (discharging chamber 4*c*) is provided. This feeding member 6 is provided so as to divide a part of a region of the accommodating portion 2 into substantially two portions and is configured to rotate together integrally with the accommodating portion 2. Further, this feeding member 6 is provided with a plurality of inclined ribs 6*a* each inclined toward the flange portion 4 side with respect to the rotational axis direction of the accommodating portion 2 on each of opposite surfaces thereof. The developer fed by the feeding projection 2*a* is raised from below toward above with respect to a vertical direction by this plate-like feeding member 6 in interrelation with rotation of the accommodating portion 2. Thereafter, with further rotation of the accommodating portion 2, the developer is delivered toward the flange portion 4 by the inclined rib 6*a*. In this constitution, this inclined rib 6*a* is provided on the opposite surfaces of the feeding member 6 so that the developer is sent to the discharging portion 4*c* every half rotation of the accommodating portion 2.

(Pump Portion)

In this embodiment, as described above, in order to stably discharge the developer through a small discharge opening 4*a*, the above-described pump portion 3*a* is provided at a part of the developer supply container 1. The pump portion 3*a* is a variable-volume pump in which a volume thereof is variable and which is made of a resin material. Specifically, as the pump portion 3*a*, a pump comprising a bellows-like expansion and contraction member which is capable of expansion and contraction is employed. Specifically, a bellows-like pump is employed, and a plurality of "mountain-fold" portions and "valley-fold" portions are alternately formed periodically.

The developer supply container 1 is provided with a cam mechanism functioning as a drive conversion mechanism for converting a rotational driving force, for rotating the accommodating portion 2, received by the gear portion 2*d* into a force in a direction in which the pump portion 3*a* is reciprocated. In this embodiment, a constitution in which by converting the rotational driving force received by the gear portion 2*d* into a reciprocating force on the developer supply container 1 side, a driving force for rotating the accommodating portion 2 and a driving force for reciprocating the pump portion 3*a* are received by a single drive-inputting portion (gear portion 2*d*) is employed.

Here, part (a) of FIG. 8 is a partial view of the pump portion 3*a* in a state in which the pump portion 3*a* is expanded to the maximum in use, and part (b) of FIG. 8 is a partial view of the pump portion 3*a* in a state in which the pump portion 3*a* is contracted to the maximum in use. As shown in parts (a) and (b) of FIG. 8, as an intervening member for converting the rotational driving force into the reciprocating force of the pump portion 3*a*, a reciprocating member 3*b* is used. Specifically, the gear portion 2*a* receiving the rotational driving force from the driving gear 300 and a cam groove 2*b* provided with a groove extending through one full circumference are rotated. With this cam groove 2*b*, a reciprocating member engaging projection 3*c* projected partly from the reciprocating member 3*b* engages. Further, a rotational direction of the reciprocating member 3*b* is restricted by a protective cover 4*e* (part (b) of FIG. 5) so that the reciprocating member 3*b* itself does not rotate in the rotational to direction of the accommodating portion 2. The reciprocating member 3*b* reciprocates along the groove of the cam groove 2*b* (in an arrow X direction or an opposite direction) by being restricted in rotational direction thereof. That is, the cam groove 2*b* is rotated by the rotational driving force inputted from the driving gear 300, so that the reciprocating member engaging projection 3*c* reciprocates in the arrow X direction or the opposite direction. Correspondingly, the pump portion 3*a* alternately repeats an expanded state (part (a) of FIG. 8) and a contracted state (part (b) of FIG. 8) and thus a volume of the developer supply container 1 is made variable.

By this expansion and contraction operation of the pump portion 3*a*, a pressure in the developer supply container 1 is changed, and discharge of the developer is carried out by utilizing the pressure. Specifically, when the pump portion 3*a* is contracted, in side of the developer supply container 1 is in a pressed state, so that the developer is discharged through the discharge opening 4*a* in a manner such that the developer is pushed out by the pressure. Further, when the pump portion 3*a* is expanded, the inside of the developer supply container 1 is in a reduced pressure state, so that outside air is taken in from the outside of the developer supply container 1 through the discharge opening 4*a*. The developer in the neighborhood of the discharge opening 4*a* is loosened by the outside air taken in through the discharge opening 4*a*, so that subsequent discharge is smoothly carried out. The developer is discharged through the discharge opening 4*a* in accordance with a pressure difference between the inside pressure and the ambient pressure (outside pressure) of the developer supply container 1 generated by repetitive execution of the above-described expansion and contraction operation by the pump portion 3*a*.

Incidentally, a discharging method of the developer from the developer supply container 1 is not limited to the expansion and contraction of the to above-described pump portion 3*a*. For example, the developer supply container 1 may also have a structure in which the developer supply container 1 is not provided with the pump portion and the diameter of the discharge opening 4*a* is made larger than an opening area and in which the developer deposited on the discharging chamber (discharging portion) 4*c* is discharged by gravitation. Further, the developer supply container 1 may also have a constitution in which the pump portion is not provided and the developer is sent to a discharging path by a rotatable member 6*b* provided just above an inlet of the discharging path.

(Material of Developer Supply Container)

In this embodiment, as described above, the constitution in which the developer is discharged through the discharge opening 4*a* by changing the volume of the inside of the developer supply container 1 by the pump portion 3*a* is employed. Therefore, as a material of the developer supply container 1, a material having rigidity to the extent that a resultant developer supply container is largely collapsed due to a volume changer or the developer supply container is not expanded may preferably be employed. In this embodiment, the developer supply container 1 communicates with the outside only through the discharge opening 4*a* during the discharge of the developer and thus has a constitution in which the developer supply container 1 is hermetically sealed from the outside except for the discharge opening 4*a*. that is, a constitution in which the developer is discharged through the discharge opening 4*a* by decreasing and increasing the volume of the developer supply container 1 by the pump portion 3*a* is employed, and therefore, hermetically to the extent that a stable discharging performance is required. Therefore, in this embodiment, a material of the accommodating portion 2 is PET resin, a material of the flange portion 4 is polystyrene resin, and a material of the pump portion 3*a* is polypropylene resin.

Incidentally, as regards the materials used, when the materials of the accommodating portion 2 and the flange portion 4 are capable of withstanding the volume change, for example, it is possible to use other resin materials such as ABS (acrylonitrile-butadiene-styrene copolymer), polyester, polyethylene and polypropylene. As regards the material of the pump portion 3*a*, the material may only be required that the material exhibits an expansion and contraction function and is capable of changing the volume of the developer supply container 1 by the volume change thereof. For example, the pump portion 3*a* may also be formed in a thin film of ABS, polystyrene, polyester, polyethylene or the like, or it is also possible to use a rubber or another material having expansion and contraction properties.

Next, a manner of mounting the above-described accommodating portion 2 and the flange portion 4 will be described with reference to parts (a) and (b) of FIG. 9. The accommodating portion 2 is rotatably loose-fitted in the discharging portion 4*c* of the flange portion 4 on one end side of the discharging portion 4*c*. In the case of this embodiment, the downstream cylindrical portion 42 is formed in an inner diameter of "φ38 mm (+0.10/0)", and the projected annular portion 52 is formed in an outer diameter of "φ38 mm (−0.02/−0.12)", so that the downstream cylindrical portion 42 and the projected annular portion 52 is in a loose fitting relationship. Further, the upstream cylindrical portion 40 is formed in an inner diameter of "φ46 mm (+0.10/0)", and the second circular rib 53 is formed in an outer diameter of "φ46 mm (−0.01/−0.12)", so that the upstream cylindrical portion 40 and the second circular rib 53 are in a loose fitting relationship. This is for the purpose of rotating the accommodating portion 2 smoothly even when deviation between an inner diameter circle center of the upstream cylindrical portion 40 and an outer diameter circle center of the second circular rib 53 occurs due to component part variation or the like. Further, as regards a length (thickness) of each of the projected annular portion 52 and the second circular rib 53 of the accommodating portion 2, these portions are formed so that a contact width (sliding width) is, for example, "0.5 mm", with the result that a load when the accommodating portion 2 is rotated is reduced.

Incidentally, in this embodiment, with respect to the rotational axis direction of the accommodating portion 2, a distance (L1 in part (b) of FIG. 9) between a first contact portion P1 where the downstream cylindrical portion 42 and the projected annular portion 52 contact each other and a second contact portion P2 where the upstream cylindrical portion 40 and the second circular rib 53 contact each other was "15 mm". Further, in a state in which the accommodating portion 2 is not inclined relative to the discharging portion 4*c*, a gap by the loose fitting may preferably be set at 0.30 mm or less.

In a state in which the accommodating portion 2 is loose-fitted in the discharging portion 4*c*, movement of the accommodating portion 2 in the rotational axis direction is restricted by the discharging portion 4*c*. Specifically, as shown in parts (a) and (b) of FIG. 9, the first circular rib 51 of the accommodating portion 2 is locked by the locking claws 41 formed inside the upstream cylindrical portion 40 of the discharging portion 4*c*. Then, the elastic seal member 60 is provided on a side opposite from a surface side of the first circular rib 51 locked by the locking claws 41, so that the seal member 60 is compressed by being nipped by the first circular rib 51 and the seal nipping portion 43 of the discharging portion 4*c*. During rotation of the accommodating portion 2, the seal member 60 slides on the seal nipping portion 43 of the discharging portion 4*c*. Thus, the accommodating portion 2 is prevented from causing whirling motion by a seal repelling force generated by abutting and compressing the seal member 60 against the seal nipping portion 43.

Incidentally, in the case of this embodiment, in the state in which the accommodating portion 2 is not inclined, a seal compression amount is set so that the thickness thereof (E1 in the figure) after compression is, for example, "2.2 mm" relative to the thickness thereof, after the compression.

On the other hand, as regards restriction of movement of the accommodating portion 2 in the radial direction, in the neighborhood of the opening 50 and on a side downstream of the seal member 60 with respect to the insertion direction, an inner peripheral surface of the downstream cylindrical portion 42 and an outer peripheral surface of the projected annular portion 52 contact each other. In addition, on a side upstream of the seal member 60 with respect to the insertion direction, an inner peripheral surface of the upstream cylindrical portion 40 and an outer peripheral surface of the second circular rib 53 contact each other. Thus, the restriction of the movement of the accommodating portion 2 is realized. That is, the accommodating portion 2 is contacted obliquely to the discharging portion 4*c* at two distant positions with respect to the insertion direction, so that the movement of the accommodating portion 2 in the radial direction is restricted.

In the case of this embodiment, as can be understood from parts (a) and (b) of FIG. 9, the seal member 60 is disposed between the projected annular portion 52 and the second circular rib 53 (specifically within a range shown by L1 in part (b) of FIG. 9). The seal member 60 is caused so that the seal member 60 can be disposed at the position, whereby it is possible to suppress deformation of the seal member 60 due to rotation of the accommodating portion 2 in a state in which the accommodating portion 2 is inclined relative to the discharging portion 4*c*.

In the following, this point will be described with reference to FIG. 10.

As shown in FIG. 10, the accommodating portion 2 is rotated by transmission of the rotational drive (rotatable driving force) from the driving gear 300 to the gear portion 2*d* provided at the outer periphery of the accommodating portion 2. When the accommodating portion 2 is rotated, in the accommodating portion 2, a radial load is capable of generating in the radial direction (specifically an arrow F direction in FIG. 10) due to a rotational load by the driving gear 300. An upstream side of the accommodating portion 2 with respect to the insertion direction is mounted in the mounting portion 10, and therefore, when the radial load generates, the accommodating portion 2 is inclined in the arrow F direction in FIG. 10 relative to the discharging portion 4*c* by the influence thereof, so that the whirling motion can occur not a little. The rotational load of the accommodating portion 2 is not constant but fluctuates, and therefore, a degree of the whirling motion is also not constant. Incidentally, herein, the state in which the accommodating portion 2 is inclined relative to the discharging portion 4*c* refers to a state in which a rectilinear line R passing through a radial center of the downstream cylindrical portion 42 (and the upstream cylindrical portion 40) and a rotational axis R' of the accommodating portion 2 cross each other. On the other hand, a state in which the accommodating portion 2 is not inclined relative to the discharging portion 4*c* refers to a state in which the above-described center line R and the rotational axis R' substantially coincide with each other (do not cross each other).

Further, in the case of this embodiment, when the accommodating portion 2 is inclined by a radial load F, the first circular rib 51 of the accommodating portion 2 is abutted against and contacted to the locking claws 41 on the driving gear 300 side. Therefore, accommodating portion 2 is inclined while being rotated with, as a supporting point, a contact portion between the first circular rib 51 and the locking claw 41. Then, on an opposite side where the accommodating portion 2 is rotated (moved) 180° from the driving gear 300 in the circumferential direction thereof, the second circular rib 53 abuts and contacts the second contact portion P2 of the inner peripheral surface of the upstream cylindrical portion 40. On the other hand, on the driving gear 300 side, the projected annular portion 52 abuts and contacts the first contact portion P1 of the inner peripheral surface of the downstream cylindrical portion 42, so that the accommodating portion 2 is not inclined further. When the accommodating portion 2 is inclined, the pressure applied to the seal member 60 by the first circular rib 51 is different between the driving gear 300 side and the opposite side from the driving gear 300 side. A difference, in pressure applied to the seal member 60 by the first circular rib 51, between the driving gear 300 side and the opposite side from the driving gear 300 side increases with an increasing degree of the inclination of the accommodating portion 2.

In this embodiment, first, the inclination of the accommodating portion 2 is suppressed by the projected annular portion 52 and the second circular rib 53. Then, as described above, when the inclination of the accommodating portion 2 is restricted at different positions (P2, P1) spaced from each other with respect to the rotational axis direction, an oscillation center Q of the accommodating portion 2 is formed between the projected annular portion 52 and the second circular rib 53 (within the range shown by L1 in part (b) of FIG. 9). Thus, the seal member 60 is disposed so as to be close to the oscillation center Q. As a result, even when the accommodating portion 2 is inclined (oscillated), pressure exerted on the seal member in the rotational axis direction by the accommodating portion 2 does not fluctuate largely compared with before the accommodating portion 2 is inclined. Accordingly, the pressure exerted on the seal member in the rotational axis direction does not fluctuate largely with respect to the circumferential direction, so that the seal member 60 cannot locally deform largely.

Here, in this embodiment ("FIRST EMB.") and a conventional example ("CONN. EX."), a comparison result of thicknesses of the seal members 60 in the case where the accommodating portions 2 are rotated in the inclined state is shown in FIG. 11. In the conventional example, compared with this embodiment, a constitution in which the accommodating portion 2 is provided with the first circular rib 51 but not provided with the projected annular portion 52 and the second circular rib 53 is employed. Incidentally, in FIG. 11, the ordinate represents one rotation (cyclic) period of the accommodating portion 2, and the abscissa represents a seal thickness of the seal member 60 at an arbitrary seal contact position.

As can be understood from FIG. 11, when the accommodating portion 2 causes the whirling motion, every rotation of the accommodating portion 2, the seal member 60 repeats displacement in a direction of further compressing the seal member 60. For this reason, the seal member 60 repeats excessive compression in a compression amount which is a desired compression amount or more. The excessive compression amount was represented by E in FIG. 11. In this embodiment, compared with the conventional example, the excessive compression amount was able to be suppressed to 50%. That is, it was possible to suppress the deformation of the seal member 60 due to the rotation of the accommodating portion 2 in the inclined state relative to the discharging portion 4*c*.

As described above, according to this embodiment, in the inclination of the accommodating portion 2 can be reduced by disposing the radial restricting portions (engaging portions) at positions upstream and downstream of the seal member 60 with respect to the insertion direction of the accommodating portion 2. Further, a distance between the restricting portions can be made long, so that the seal member 60 can be disposed so as to be close to the oscillation center Q of the accommodating portion 2. As a result, the pressure applied to the seal member 60 in the rotational axis direction by the accommodating portion 2 cannot fluctuate largely compared with before the accommodating portion 2 is inclined, so that the seal member 60 cannot be largely deformed locally. Thus, in this embodiment, while suppressing the whirling motion of the accommodating portion 2 by the seal member 60, deformation of the seal member 60 due to the rotation of the accommodating portion 2 in the inclined state relative to the discharging portion 4*c* can be suppressed by a simple constitution.

Second Embodiment

A developer supply container of Second Embodiment will be described with reference to FIG. 12 to part (b) of FIG. 14. The developer supply container of Second Embodiment includes an accommodating portion 2A which is formed in a hollow cylindrical shape and which accommodates the developer therein, and includes a flange portion 4A. Also in Second Embodiment, the feeding member 6 and the pump portion 3*a* are provided, but these are similar to those in the above-described First Embodiment, and therefore are omitted from illustration and description. Further, constituent elements which are the same as those in the above-described First Embodiment will be omitted from description or briefly described by adding the same reference numerals or symbols thereto.

(Accommodating Portion)

As shown in FIG. 12, at one end of the accommodating portion 2A on a downstream side with respect to the insertion direction, a small diameter cylindrical portion 2*e* provided, with an opening 50 for permitting discharge of the developer toward the discharging portion 4*c* is formed. On an outer peripheral surface of the small diameter cylindrical portion 2*e*, a first circular rib 51 and a second circular rib 53 which have a ring shape and which project outward in a radial direction crossing the rotational axis direction of the accommodating portion 2A are provided at positions spaced from each other with respect to the longitudinal direction of the developer supply container.

To the first circular rib 51, a ring-shaped seal member 60 formed by an elastic member such as an urethane foam is bonded. Further, in this embodiment, a free end cylindrical portion 54 having an inner diameter larger than an outer diameter of the small diameter cylindrical portion 2*e* so as to surround the seal member 60. In other words, in the accommodating portion 2A, the free end cylindrical portion 54 is formed so as to project toward a side downstream of the first circular rib 51 with respect to the insertion direction, and the seal member 60 is provided at an inner periphery of the free end cylindrical portion 54.

Also in this embodiment, the accommodating portion 2A is mounted to the flange portion 4 so as to be rotatable relative to the flange portion 4A (FIG. 13) in a state that the seal member 60 is elastically deformed. As regards the accommodating portion 2, in order to rotate while sliding with the seal member 2, hermetically in the developer supply container 1 is maintained by the seal member 60. Further, in this embodiment, as described later motion of the accommodating portion 2A in the rotational axis direction is restricted by the first circular rib 51, and motion of the accommodating portion 2A in the radial direction is restricted by the free end cylindrical portion 54 as a first restricting portion and the second circular rib 53 as a second restricting portion.

(Flange Portion)

The flange portion 4A is provided, as shown in FIG. 13, with the hollow discharging portion (discharging chamber) 4*c* for temporarily storing and then discharging the developer which is fed from the accommodating portion 2A. The discharging portion 4*c* is provided with the discharge opening 4*a* at the bottom thereof.

The flange portion 4A is configured so that the accommodating portion 2A is mountable on a side opposite from the pump portion 3*a*. Specifically, in the order from an upstream side of the discharging portion 4*c* with respect to the insertion direction, as receiving portions, an upstream cylindrical portion (second cylindrical portion) 40 and a downstream cylindrical portion 44 which are provided for permitting mounting of the accommodating portion 2A through loose fitting are formed. The downstream cylindrical portion 44 includes a seal abutment portion 45 for compressing and nipping the seal member 60 between itself and the first circular rib 51 (part (b) of FIG. 14). The seal abutment portion (first cylindrical portion) 45 is provided so as to project from an end portion of the downstream cylindrical portion 44 in the opposite direction to the insertion direction so that the seal abutment portion 45 enters the upstream cylindrical portion 40. On the other hand, the upstream cylindrical portion 40 is provided with a plurality of locking claws 41, each projecting toward an inside with respect to the radial direction.

The accommodating portion 2A is rotatably loose-fitted in the discharging portion 4*c* of the flange portion 4A on one end side of the discharging portion 4*c*. In the case of this embodiment, as shown in parts (a) and (b) of FIG. 14, the downstream cylindrical portion 44 and the free end cylindrical portion 54 are in a loose fitting relationship, and the upstream cylindrical portion 40 and the second circular rib 53 are in the loose fitting relationship.

In a state in which the accommodating portion 2A is loose-fitted in the discharging portion 4*c*, movement of the accommodating portion 2A in the rotational axis direction is restricted by the discharging portion 4*c* by locking of the first circular rib 51 by the locking claws 41. Then, the elastic seal member 60 is provided on a side opposite from a surface side of the first circular rib 51 locked by the locking claws 41, so that the seal member 60 is compressed by being nipped by the first circular rib 51 and the seal abutment portion 45. During rotation of the accommodating portion 2A, the seal member 60 slides on the seal abutment portion 45. Thus, the accommodating portion 2A is prevented from causing whirling motion by a seal repelling force generated by abutting and compressing the seal member 60 against the seal abutment portion 45.

On the other hand, as regards restriction of movement of the accommodating portion 2A in the radial direction, in the neighborhood of the opening 50 and on a side downstream of the seal member 60 with respect to the insertion direction, an outer peripheral surface of the seal abutment portion 45 and an inner peripheral surface of the free end cylindrical portion 54 contact each other. In addition, on a side upstream of the seal member 60 with respect to the insertion direction, an inner peripheral surface of the upstream cylindrical portion 40 and an outer peripheral surface of the second circular rib 53 contact each other. Thus, the restriction of the movement of the accommodating portion 2A is realized. That is, the accommodating portion 2A is contacted obliquely to the discharging portion 4*c* at two distant positions with respect to the insertion direction, so that the movement of the accommodating portion 2A in the radial direction is restricted.

That is, in the case of this embodiment, when the accommodating portion 2A is inclined depending on a radial load F by the driving gear 300 (FIG. 10), the first circular rib 51 of the accommodating portion 2A is abutted against and contacted to the locking claws 41 on the driving gear 300 side. Therefore, accommodating portion 2A is inclined while being rotated with, as a supporting point, a contact portion between the first circular rib 51 and the locking claw 41. Then, on an opposite side where the accommodating portion 2 is rotated (moved) 180° from the driving gear 300 in the circumferential direction thereof, the second circular rib 53 abuts and contacts the second contact portion P2 of the inner peripheral surface of the upstream cylindrical portion 40. On the other hand, on the driving gear 300 side, the inner peripheral surface of the free end cylindrical portion 54 abuts and contacts the first contact portion P1 with the outer peripheral surface of the seal abutment portion 45, so that the accommodating portion 2A is not inclined further.

As described above, when the inclination of the accommodating portion 2 is restricted at different positions (P2, P1) spaced from each other with respect to the rotational axis direction, an oscillation center of the accommodating portion 2A is formed between the free end cylindrical portion 54 and the second circular rib 53 (within a range shown by L2 in part (b) of FIG. 14). Thus, the seal member 60 is disposed between the free end cylindrical portion 54 and the second circular rib 53 so as to be close to the oscillation center of the accommodating portion 2A. As a result, even when the accommodating portion 2A is inclined (oscillated), pressure exerted on the seal member in the rotational axis direction by the accommodating portion 2A does not fluctuate largely compared with before the accommodating portion 2A is inclined. Accordingly, the pressure exerted on the seal member in the rotational axis direction does not fluctuate largely with respect to the circumferential direction, so that the seal member 60 cannot locally deform largely.

As described above, also by this embodiment, an effect such that while suppressing the whirling motion of the accommodating portion 2A by the seal member 60, deformation of the seal member 60 due to the rotation of the accommodating portion 2A in the inclined state relative to the discharging portion 4*c* can be suppressed by a simple constitution is achieved.

Other Embodiments

Incidentally, the developer supply container 1 of this embodiment may also be a developer supply container 1 in which the pump portion 3*a* is not provided. In this case, constituent elements other than the pump portion 3*a* may also be similar to those in the above-described embodiments. As regards the feeding of the developer in the developer supply container 1, a constitution in which the developer is fed toward the discharging portion 4*c* by the accommodating portion 2 and the feeding member 6 may also be employed.

According to the above-described embodiment, while suppressing the whirling motion of the accommodating portion by the seal member, deformation of the seal member due to rotation of the accommodating portion in the state in which the accommodating portion is inclined relative to the discharging portion can be suppressed by a simple constitution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-162136 filed on Aug. 30, 2018, which is hereby incorporated by reference herein in its entirety.

What is claimed is:

1. A developer supply container comprising:

an accommodating portion including one end portion provided with an opening, wherein developer accommodated in the accommodating portion can be fed toward the one end portion by rotation of the accommodating portion;

a discharging portion including (i) a receiving portion into which the one end portion of the accommodating portion is inserted so as to be rotatable relative to the accommodating portion, the receiving portion including a cylindrical projection projecting toward an accommodating portion side and inserted into the one end portion, and (ii) a discharge opening configured to discharge the developer supplied through the opening of the accommodating portion;

a sealing member configured to seal a space between the one end portion and the cylindrical projection by being elastically compressed;

a first restricting portion (i) provided on the one end portion and configured to restrict movement of the accommodating portion in a radial direction crossing a rotational axis direction of the accommodating portion and (ii) in contact with an outer wall surface of the cylindrical projection; and a second restricting portion (i) contactable to an inner wall of the receiving portion on a side upstream of the first restricting portion with respect to an inserting direction of the one end portion and (ii) configured to restrict the movement of the accommodating portion in the radial direction, wherein the seal member is provided between the first restricting portion and the second restricting portion with respect to the rotational axis direction.

2. The developer supply container according to claim 1, wherein the discharging portion includes a retaining portion configured to lock a part of the accommodating portion in the receiving portion so that the one end portion is prevented from disengaging from the receiving portion.

3. The developer supply container according to claim 2, wherein the accommodating portion is provided with a rib portion projecting from an outer peripheral surface in the radial direction at the one end portion, wherein the retaining portion locks the rib portion, and wherein the seal member is compressed in the rotational axis direction by the rib portion being locked by the retaining portion.

4. The developer supply container according to claim 3, wherein the seal member is provided on the rib portion.

5. The developer supply container according to claim 1, wherein the accommodating portion includes, on an outer peripheral surface thereof, a gear portion configured to receive a rotational driving force from an external gear.

* * * * *